US011697563B2

(12) United States Patent
Tomita

(10) Patent No.: US 11,697,563 B2
(45) Date of Patent: Jul. 11, 2023

(54) SHEET CONVEYANCE DEVICE, SHEET FEEDING DEVICE, AND IMAGE FORMING APPARATUS

(71) Applicant: Ricoh Company, Ltd., Tokyo (JP)

(72) Inventor: Kenji Tomita, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 65 days.

(21) Appl. No.: 17/336,833

(22) Filed: Jun. 2, 2021

(65) Prior Publication Data

US 2021/0380359 A1 Dec. 9, 2021

(30) Foreign Application Priority Data

Jun. 3, 2020 (JP) ..... 2020-097114

(51) Int. Cl.
*B65H 3/06* (2006.01)
*B65H 5/06* (2006.01)
*B65H 3/52* (2006.01)

(52) U.S. Cl.
CPC ..... *B65H 3/0669* (2013.01); *B65H 3/5261* (2013.01); *B65H 5/062* (2013.01); *B65H 2403/722* (2013.01)

(58) Field of Classification Search
CPC .... B65H 3/0669; B65H 3/5261; B65H 5/062; B65H 2403/722; B65H 2403/72; B65H 2403/721
See application file for complete search history.

(56) References Cited

U.S. PATENT DOCUMENTS 7,441,763 B2 * 10/2008 Su ..... B65H 3/5223 271/10.11
8,186,667 B2 5/2012 Hirabayashi et al.
8,336,872 B2 12/2012 Liu
9,085,429 B1 * 7/2015 Cheng ..... B65H 3/5238
9,776,433 B2 10/2017 Nishimura
(Continued)

FOREIGN PATENT DOCUMENTS

JP 2010-059998 3/2010
JP 2012-082041 4/2012
(Continued)

OTHER PUBLICATIONS

Extended European Search Report dated Oct. 29, 2021 in European Patent Application No. 21176369.3, 7 pages.

*Primary Examiner* — Luis A Gonzalez
(74) *Attorney, Agent, or Firm* — Xsensus LLP

(57) ABSTRACT

A sheet conveyance device includes a first conveyance member, and a drive transmission mechanism. The first conveyance member is configured to convey a sheet toward a second conveyance member. The drive transmission mechanism is configured to transmit a driving force of a driving source to the first conveyance member. The drive transmission mechanism includes a first drive transmitter and a second drive transmitter disposed coaxially with the first drive transmitter. The driving force is transmitted from the first drive transmitter to the second drive transmitter. The second drive transmitter is rotatable relative to the first drive transmitter within at least a predetermined angular range.

8 Claims, 9 Drawing Sheets

(56) References Cited

U.S. PATENT DOCUMENTS

| | | | | |
|---|---|---|---|---|
| 2007/0267805 | A1* | 11/2007 | Lai | B65H 3/06 271/121 |
| 2009/0129840 | A1 | 5/2009 | Takekawa et al. | |
| 2016/0091856 | A1 | 3/2016 | Irie et al. | |
| 2020/0172368 | A1 | 6/2020 | Susaki et al. | |
| 2020/0231399 | A1 | 7/2020 | Shibata et al. | |

FOREIGN PATENT DOCUMENTS

| | | |
|---|---|---|
| JP | 2013-040036 | 2/2013 |
| JP | 2019-182616 | 10/2019 |

* cited by examiner

SHEET CONVEYANCE DEVICE, SHEET FEEDING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2020-097114, filed on Jun. 3, 2020, in the Japan Patent Office, the entire disclosure of which is hereby incorporated by reference herein.

BACKGROUND

Technical Field

Embodiments of the present disclosure relate to a sheet conveyance device, a sheet feeding device, and an image forming apparatus.

Description of the Related Art

There is known a sheet conveyance device including a first conveyance member and a drive transmission mechanism. The first conveyance member conveys a sheet toward a second conveyance member that conveys the sheet. The drive transmission mechanism transmits a driving force of a drive source to the first conveyance member.

One example of such a sheet conveyance device discloses a sheet conveyance device in which a one-way clutch is provided in a drive transmission mechanism that transmits a driving force of a driving source to a first conveyance member. When the sheet conveyance speed of a second conveyance member is higher than the sheet conveyance speed of the first conveyance member and the first conveyance member is pulled by the sheet, the first conveyance member idles due to the action of the one-way clutch, and the first conveyance member rotates at the sheet conveyance speed of the second conveyance member.

SUMMARY

In an aspect of the present disclosure, a sheet conveyance device includes a first conveyance member and a drive transmission mechanism. The first conveyance member is configured to convey a sheet toward a second conveyance member. The drive transmission mechanism is configured to transmit a driving force of a driving source to the first conveyance member. The drive transmission mechanism includes a first drive transmitter and a second drive transmitter disposed coaxially with the first drive transmitter. The driving force is transmitted from the first drive transmitter to the second drive transmitter. The second drive transmitter is rotatable relative to the first drive transmitter within at least a predetermined angular range.

In another aspect of the present disclosure, an image forming apparatus includes the sheet conveyance device configured to convey a sheet and an image forming device configured to form an image on the sheet conveyed by the sheet conveyance device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
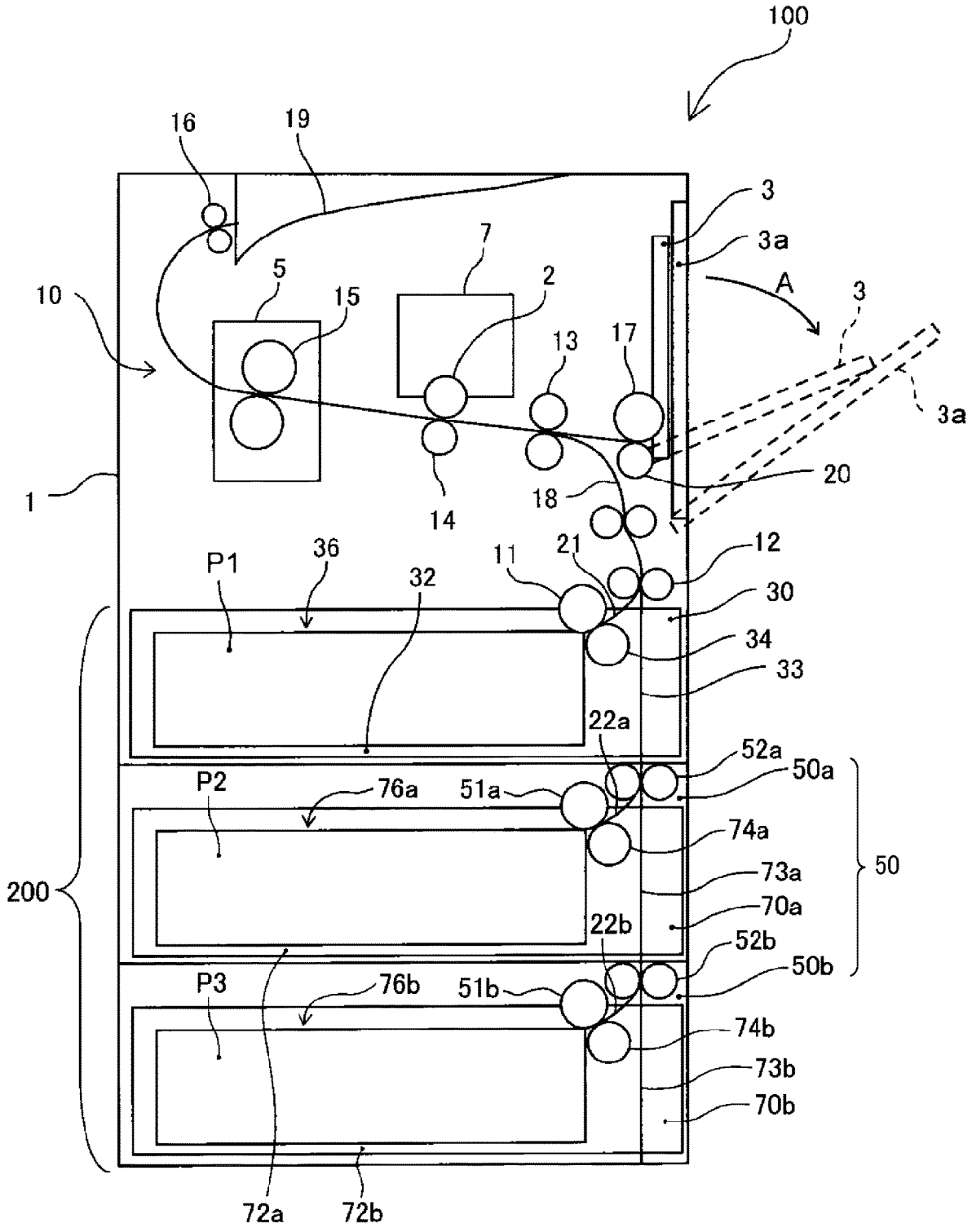
FIG. 1 is a schematic diagram illustrating a configuration of a printer as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Now, a description is given of an electrophotographic printer (hereinafter also simply referred to as a "printer") that forms an image by an electrophotographic method as an image forming apparatus according to an embodiment of the present disclosure.

Figure 2:
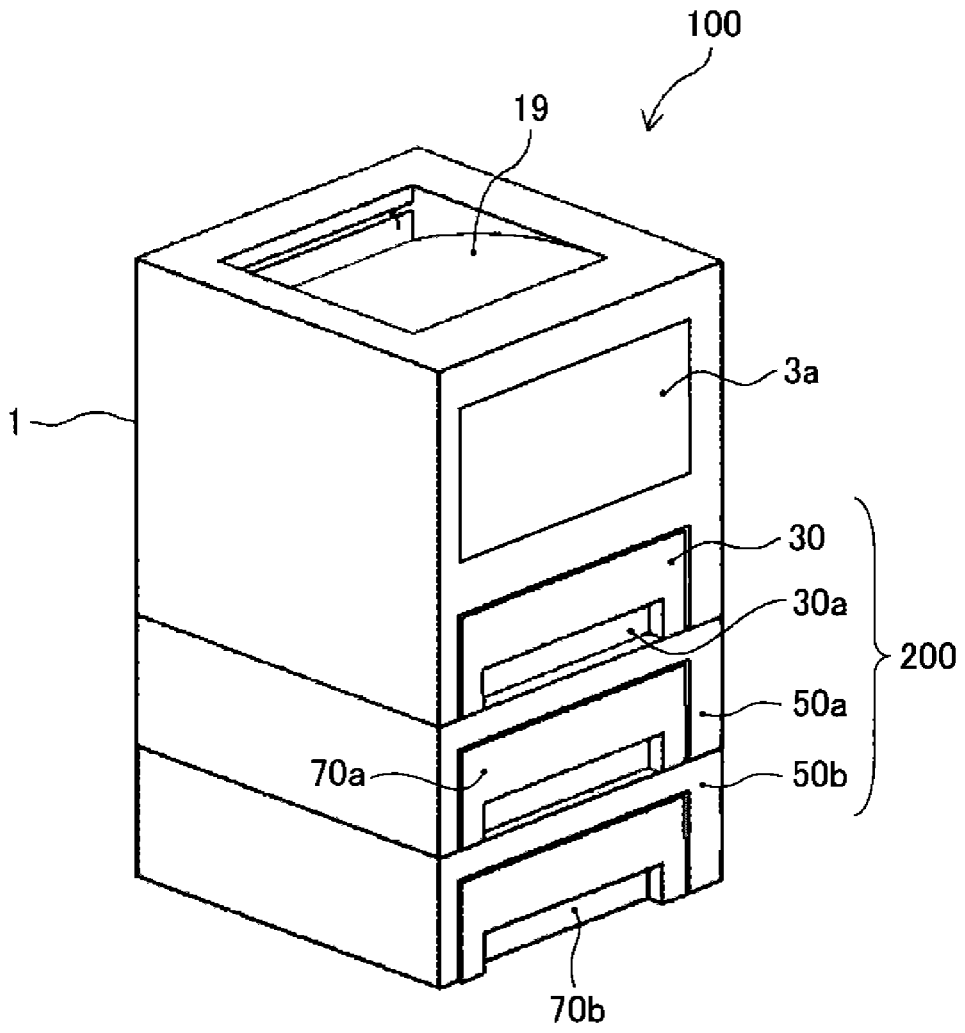
FIG. 2 is a perspective view of the printer of FIG. 1.

At first, a description is given of a basic configuration of a printer according to an embodiment of the present disclosure. FIG. 1 is a schematic diagram illustrating a configuration of a printer 100 according to the present embodiment. FIG. 2 is a perspective view of the printer 100 according to the present embodiment.

The printer 100 includes a body housing 1 provided with an image forming device 10 and two additional sheet feeders (an upper additional sheet feeder 50*a* and a lower additional sheet feeder 50*b*) having the same shape installed in a lower part of the body housing 1.

As illustrated in FIG. 1, the body housing 1 includes a regular sheet feeding tray 30 and a regular sheet feeding roller 11 in the lower part of the image forming device 10. The upper additional sheet feeder 50*a* and the lower additional sheet feeder 50*b* have the same configuration and include additional sheet feeding trays 70*a* and 70*b*, respectively, as sheet loaders and additional sheet feeding rollers 51*a* and 51*b* as sheet feeding members, respectively. The regular sheet feeding tray 30 and the additional sheet feeding trays 70*a* and 70*b* are arranged so as to be drawn out toward a front side (right side in FIG. 1) of the printer 100 with respect to the body housing 1 and a housing of the upper additional sheet feeder 50*a* and the lower additional sheet feeder 50*b*.

In the printer 100, the regular sheet feeding tray 30 in the body housing 1 and the upper additional sheet feeder 50*a* and the lower additional sheet feeder 50*b* constitute a sheet feeding device 200 as a sheet feeding device according to the present embodiment.

The regular sheet feeding tray 30 includes a regular sheet tray housing 32 forming a regular stacking device 36 on which a first sheet bundle P1 is stacked, a regular sheet feeding separation roller 34, and a regular sheet feeding guide.

The additional sheet feeding tray 70*a* of the upper additional sheet feeder 50*a* includes an additional tray housing 72*a* forming an additional stacking unit 76*a* to stack a second sheet bundle P2, an additional sheet feed separation roller 74*a*, and an additional sheet feeding guide. The additional sheet feeding tray 70*b* of the lower additional sheet feeder 50*b* includes an additional tray housing 72*b* forming an additional stacking unit 76*b* to stack a third sheet bundle P3, an additional sheet feed separation roller 74*b*, and an additional sheet feeding guide.

The body housing 1 includes a bypass sheet feeding tray 3 and a bypass sheet feed exterior cover 3*a* on the front side (right side in FIG. 1) of the printer 100. A bypass sheet feed unit includes the bypass sheet feed exterior cover 3*a*, the bypass sheet feeding tray 3, and a bypass sheet feeding roller 17. When the bypass sheet feed exterior cover 3*a* is rotated in the direction indicated by arrow A in FIG. 1 and moved to the position indicated by the broken line in FIG. 1, the bypass sheet feeding tray 3 is moved to the position indicated by the broken line in FIG. 1 in conjunction with the movement of the bypass sheet feed exterior cover 3*a* and the bypass sheet feeding roller 17 feeds the sheet.

The image forming device 10 includes a photoconductor 2 as a latent image bearer, an image forming unit 7 that forms a toner image on the surface of the photoconductor 2, a transfer roller 14 that transfers the toner image on the surface of the photoconductor 2 to a sheet, and a fixing device 5 that fixes the toner image on the sheet.

When the printer 100 forms an image, a latent image is formed on the surface of the photoconductor 2 by an exposure device included in the image forming unit 7, and the latent image on the surface of the photoconductor 2 is developed by a developing device included in the image forming unit 7 to form a toner image on the surface of the photoconductor 2.

On the other hand, from a sheet bundle stacked on the regular sheet feeding tray 30, the additional sheet feeding tray 70, or the bypass sheet feeding tray 3, sheets are fed one by one by any one of the sheet feeding rollers (the regular sheet feeding roller 11, the additional sheet feeding rollers 51*a* and 51*b*, and the bypass sheet feeding roller 17) and conveyed to a position at which the sheets abut against the registration roller pair 13.

The registration roller pair 13 is rotationally driven so as to match the timing at which the toner image on the surface of the photoconductor 2 reaches a transfer nip that is a portion facing the transfer roller 14, and the toner image on the surface of the photoconductor 2 is transferred onto the surface of the sheet at the transfer nip. The toner image is fixed to the sheet on which the toner image has been transferred by heat and pressure in the fixing device 5, and the sheet is ejected by an ejection roller pair 16 to an output tray 19.

Next, conveyance of sheets from the regular sheet feeding tray 30 and the additional sheet feeding trays 70*a* and 70*b* is described.

One sheet is fed from a first sheet bundle P1 by rotation of the regular sheet feeding roller 11 provided opposite to the first sheet bundle P1 stacked on the regular sheet feeding tray 30. The fed sheet is conveyed by the regular conveyance roller pair 12, passes through a regular conveyance path 18, and abuts against the registration roller pair 13. Next, driving the registration roller pair 13 allows the sheet to be conveyed by the registration roller pair 13, the toner image on the photoconductor 2 to be transferred to the sheet at the transfer nip at which the transfer roller 14 is disposed, and the toner image is fixed to the sheet by the fixing device 5 including the fixing roller pair 15. Thereafter, the sheet is ejected to the output tray 19 by the ejection roller pair 16.

Similarly, in the sheet feeding from the upper additional sheet feeding tray 70*a*, one sheet is fed from the second sheet bundle P2 by the rotation of the additional sheet feeding roller 51*a* facing the second sheet bundle P2 stacked on the additional sheet feeding tray 70*a*. The fed sheet is conveyed by an upper additional conveyance roller pair 52*a* provided in the additional sheet feeding device 50*a*, passes through a regular sheet feeding tray passing conveyance path 33 provided in the regular sheet feeding tray 30, and is conveyed downstream by the regular conveyance roller pair 12.

Similarly, in the sheet feeding from the lower additional sheet feeding tray 70*b*, one sheet is fed from a third sheet bundle P3 by the rotation of the additional sheet feeding roller 51*b* facing the third sheet bundle P3 stacked on the additional sheet feeding tray 70*b*. The fed sheet is conveyed by an additional conveyance roller pair 52*b* provided in the additional sheet feeder 50*b* and passes through an additional sheet feeding tray passing conveyance path 73. Then, the sheet is conveyed from an additional sheet feeding tray passing conveyance path 73*a* to the regular sheet feeding tray passing conveyance path 33, passes through the regular sheet feeding tray passing conveyance path 33, and is conveyed downstream by the regular conveyance roller pair 12.

As illustrated in FIG. 1, the printer 100 includes a regular sheet feed conveyance path 21 that guides the sheet immediately after being fed by the regular sheet feeding roller 11 from the regular sheet feeding tray 30 toward the regular conveyance path 18 located above. Further, the printer 100 includes additional sheet feed conveyance paths 22*a* and 22*b* that guide the sheet immediately after the sheet is fed by the additional sheet feeding rollers 51*a* and 51*b* from the additional sheet feeding trays 70*a* and 70*b* toward the regular sheet feeding tray passing conveyance path 33 located above.

With respect to the conveyance rollers in the body of the printer 100, the linear velocity of the conveyance rollers located upstream in the sheet conveyance direction is set to be high and the linear velocity of the conveyance rollers located downstream in the sheet conveyance direction is set to be low so that the sheet is not stretched. However, since the upper additional sheet feeder 50*a* and the lower additional sheet feeder 50*b* have the same specifications, a difference of the linear velocity is not provided between the upper additional conveyance roller pair 52*a* and the lower additional conveyance roller pair 52*b*. However, due to the dimensional tolerance of the diameters of the conveyance rollers, the linear velocity of the upper additional conveyance roller pair 52*a* may be higher than the linear velocity of the lower additional conveyance roller pair 52*b*. As described above, when the linear velocity of the upper additional conveyance roller pair 52*a* is higher than the linear velocity of the lower additional conveyance roller pair 52*b*, the sheet being conveyed by the upper additional conveyance roller pair 52*a* and the lower additional conveyance roller pair 52*b* is stretched. Then, the lower additional conveyance roller pair 52*b* may slip with the sheet, and the sheet may be conveyed at the linear velocity of the upper additional conveyance roller pair 52*a*. When the lower additional conveyance roller pair 52*b* slips with the sheet, a slip sound may be generated.

Therefore, in a conventional technology, a one-way clutch is provided in a drive transmission mechanism that transmits a driving force of a motor to an additional conveyance roller pair. When the linear velocity of an upper additional conveyance roller pair is higher than the linear velocity of a lower additional conveyance roller pair, the lower additional conveyance roller pair idles due to the action of the one-way clutch. Thus, the lower additional conveyance roller pair can be prevented from slipping with a sheet.

However, the one way clutch generally includes an outer ring, an inner ring, a plurality of rollers provided between the outer ring and the inner ring, and a plurality of springs for biasing the respective rollers, and is expensive due to a large number of components. Therefore, there is a disadvantage that the cost of the additional sheet feeding device increases.

Therefore, in the present embodiment, the idle rotation of the lower additional conveyance roller pair 52*b* is enabled without the one-way clutch. Hereinafter, features of the present embodiment are further described with reference to drawings.

Figure 3A:
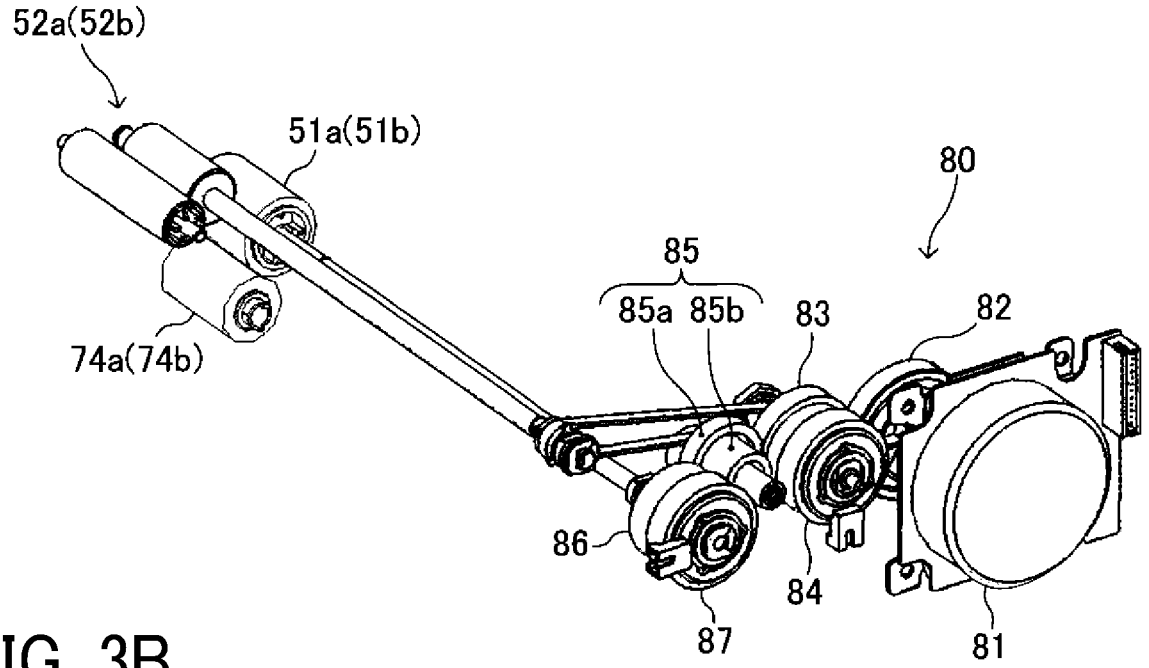
FIGS. 3A and 3B are perspective views of a driving device mounted on each of additional sheet feeding devices of a printer according to an embodiment of the present disclosure.
Figure 3B:
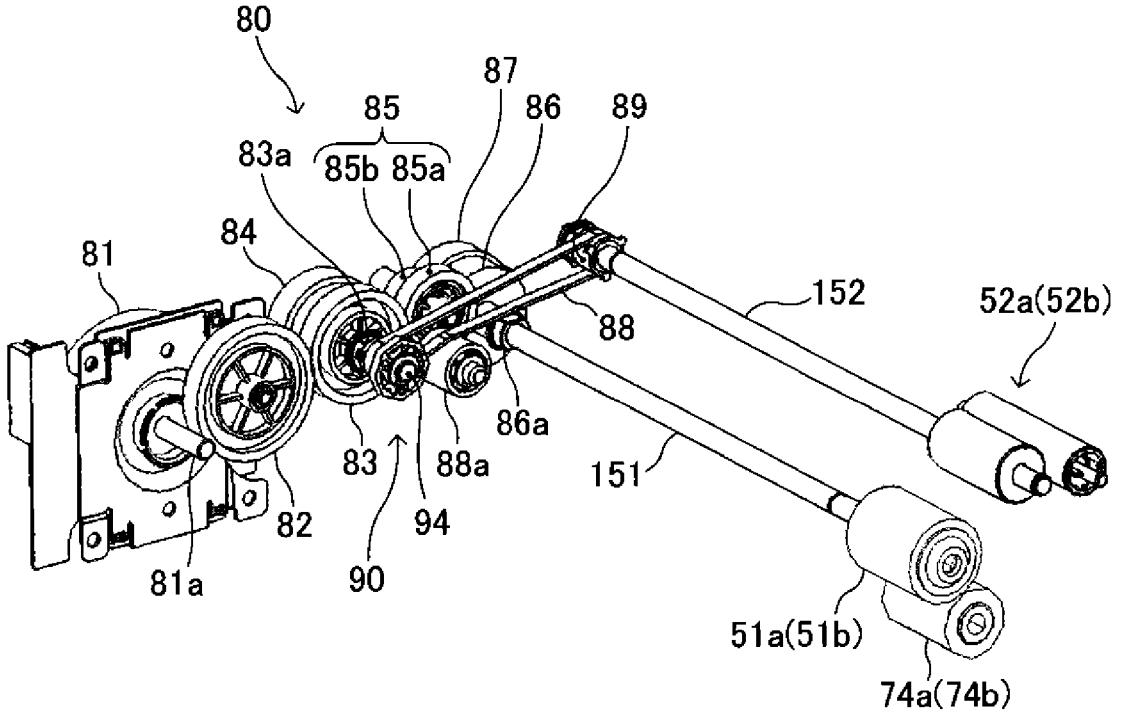

FIG. 3A is a perspective view of the driving device 80 mounted on the upper additional sheet feeder 50*a*. FIG. 3B is a perspective view of the driving device 80 mounted on the lower additional sheet feeder 50*b*. FIG. 3A is a perspective view of the driving device 80 viewed from the driving motor side. FIG. 3B is a perspective view of the driving device 80 viewed from the conveyance roller side.

The driving device 80 includes a drive motor 81 as a drive source including a brushless motor. An idler gear 82 is engaged with a motor gear directly formed on a motor shaft 81*a* of the drive motor 81, and an input gear 83 rotatably supported by the drive shaft 94 is engaged with the idler gear 82 via a bearing 83*a* (see FIGS. 4 and 5). A large-diameter gear 85*a* of a two stage gear 85 meshes with the input gear 83, and a small-diameter gear 85*b* of the two stage gear 85 meshes with a sheet feeding gear 86 rotatably supported by a shaft 151 of the additional sheet feeding roller 51*a* (or the additional sheet feeding roller 51*b*) via bearing 86*a*.

A sheet feeding electromagnetic clutch 87 for connecting and disconnecting the driving between the sheet feeding gear 86 and the shaft 151 of the additional sheet feeding roller 51*a* (or the additional sheet feeding roller 51*b*) is attached to the shaft 151 of the additional sheet feeding roller 51*a* (or the additional sheet feeding roller 51*b*). When the sheet feeding electromagnetic clutch 87 is turned on, the driving force transmitted to the sheet feeding gear 86 is transmitted to the shaft 151 of the additional sheet feeding roller 51*a* (or the additional sheet feeding roller 51*b*) via the sheet feeding electromagnetic clutch 87, and the additional sheet feeding roller 51*a* (or the additional sheet feeding roller 51*b*) is rotationally driven.

The input gear 83 is rotatably supported by a drive shaft 94 via the bearing 83*a*. A conveyance electromagnetic clutch 84 that connects and disconnects the input gear 83 and the drive shaft 94 is attached to the drive shaft 94. When the conveyance electromagnetic clutch 84 is turned on, the driving force transmitted to the sheet feeding gear 86 is transmitted to the drive shaft 94 via the conveyance electromagnetic clutch 84, and the drive shaft 94 is rotationally driven.

An idling mechanism 90 described later is attached to a side end of a roller of the drive shaft 94. A driving force transmitted to the drive shaft 94 is transmitted to the timing belt 88 via the idling mechanism 90. The driving force transmitted to the timing belt 88 is transmitted to a driven pulley 89 attached to a driving roller shaft 152 of the upper additional conveyance roller pair 52*a* (or the lower additional conveyance roller pair 52*b*). Accordingly, the upper additional conveyance roller pair 52*a* (or the lower additional conveyance roller pair 52*b*) is rotationally driven.

Note that a tightening roller 88*a* that applies tension to the timing belt 88 is illustrated in FIG. 3B.

Figure 4:
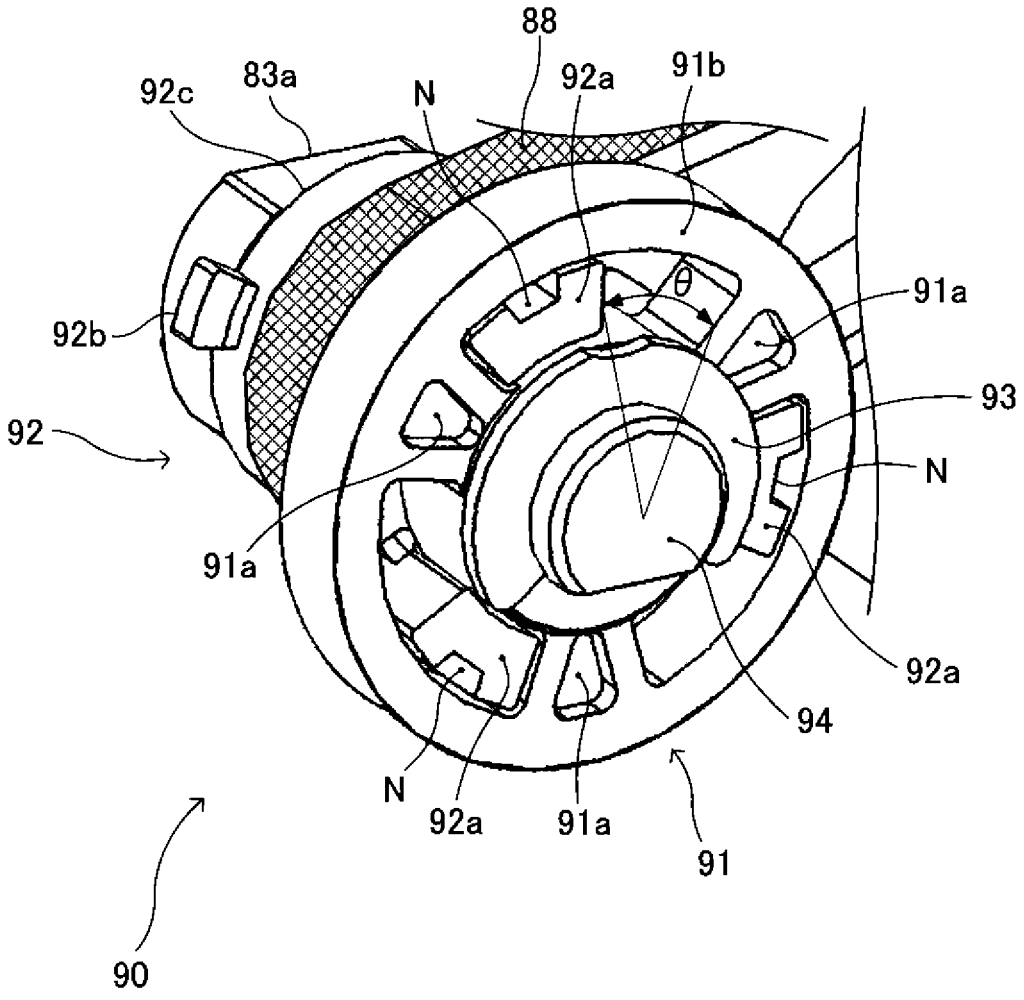
FIG. 4 is a perspective view of an idling mechanism of the driving device of FIGS. 3A and 3B, according to an embodiment of the present disclosure.
Figure 5A:
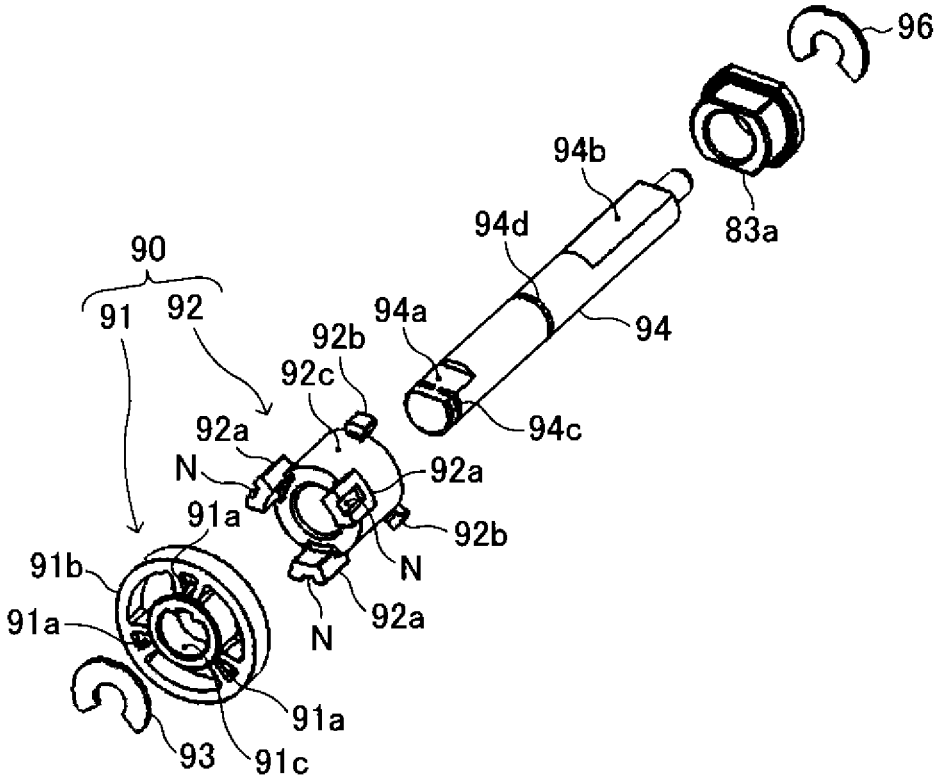
FIGS. 5A and 5B are exploded perspective views of the idling mechanism of FIG. 4.
Figure 5B:
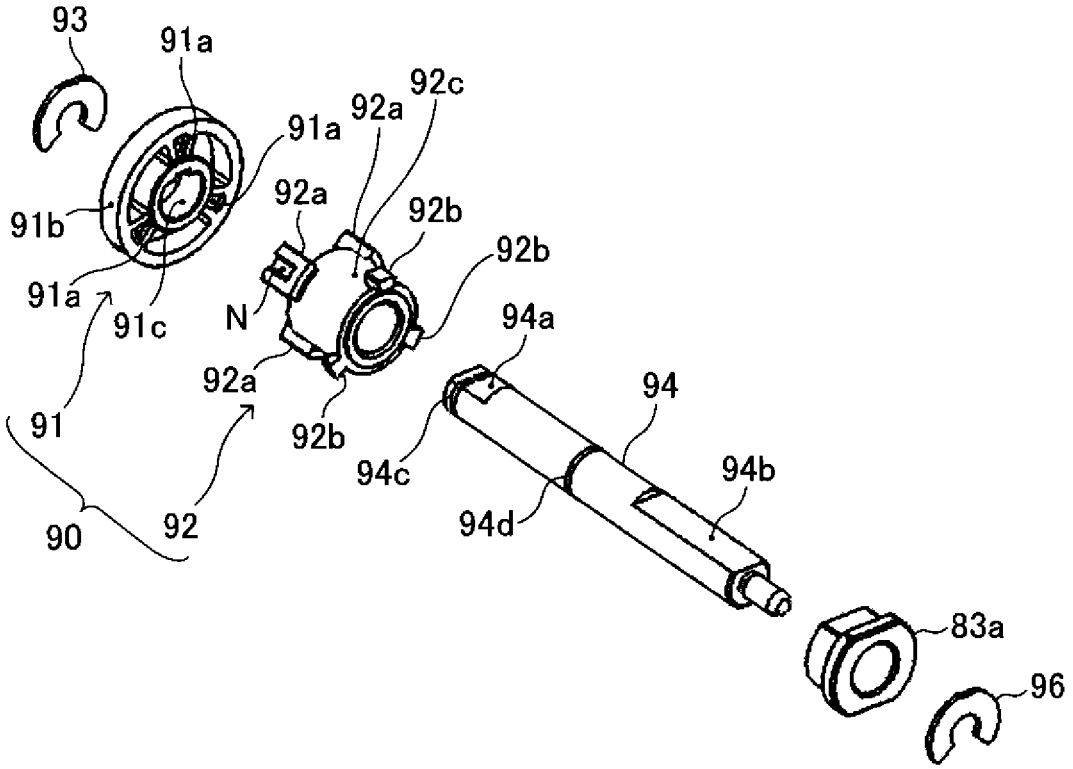

FIG. 4 is a perspective view of the idling mechanism 90. FIGS. 5A and 5B are exploded perspective views of the idling mechanism 90. FIG. 5A is an exploded perspective view of the idling mechanism 90 viewed from a conveyance roller side. FIG. 5B is an exploded perspective view of the idling mechanism 90 viewed from a drive motor side.

The idling mechanism 90 includes a first drive transmitter 91 and a second drive transmitter 92.

The first drive transmitter 91 includes a cylindrical shaft-insertion receiving portion 91*c* having an inner peripheral surface with a D-shaped cross section including a planar portion and a circular portion. Three drive claws 91*a* radially protruding from the outer peripheral surface of the cylindrical shaft-insertion receiving portion 91*c* are provided at intervals of 120° in the rotation direction of the idling mechanism 90. Further, an outer ring 91*b* is provided as a connector provided so as to connect the radial ends of the drive claws 91*a*.

The radial ends of the drive claws 91*a* are coupled with the outer ring 91*b*. Thus, the drive claws 91*a* can be reinforced in the rotation direction of the idling mechanism 90. Accordingly, deformation of the drive claws 91*a* in the rotation direction of the idling mechanism 90 can be restrained when a large load torque is applied to the drive claws 91*a*. Thus, damage to the drive claws 91*a* can be restrained.

Figure 6:
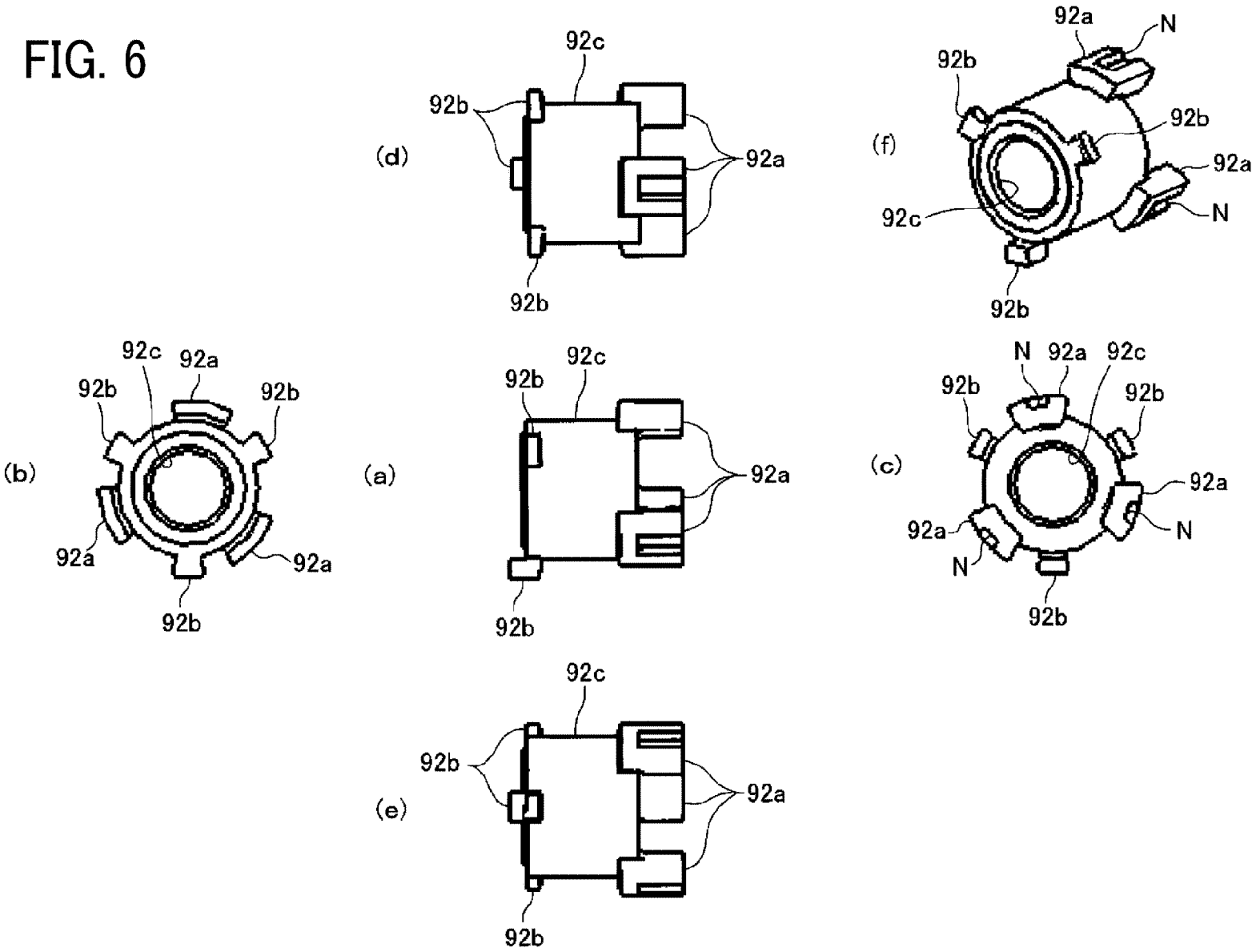
FIG. 6 is a view of a second drive transmitter of the idling mechanism of FIGS. 5A and 5B.

Part (a), (b), (c), (d), (e), and (f) of FIG. 6 are schematic views of the second drive transmitter 92. Part (a) of FIG. 6 is a front view, part (b) of FIG. 6 is a left side view, part (c) of FIG. 6 is a right side view, part (d) of FIG. 6 is a plan view, part (e) of FIG. 6 is a bottom view, and part (f) of FIG. 6 is a perspective view of the second drive transmitter 92.

The second drive transmitter 92 includes a cylindrical pulley 92*c* around which the timing belt 88 is wound. The three driven claws 92*a* are provided at an end of the pulley 92*c* on the first drive transmitter side so as to extend in a thrust direction at intervals of 120° in the rotation direction. These driven claws 92*a* are provided so as to radially protrude from the outer peripheral surface of the pulley 92*c*, and function as a slip-off stopper that prevents the driven claws 92*a* from slipping off from the pulley 92*c* of the timing belt 88.

Three retainers 92*b* are provided at a side end of the bearing 83*a* of the pulley 92*c* at intervals of 120° in the rotation direction so as to radially protrude from the outer peripheral surface of the pulley 92*c*. One of the three retainers 92*b* is provided so as to protrude from the pulley 92*c* in the thrust direction. The retainers 92*b* prevent the timing belt 88 from coming off from the side end of the bearing 83*a* of the pulley 92*c*.

The three retainers 92*b* are provided at positions shifted by 60° with respect to the driven claws 92*a* in the rotation direction. The second drive transmitter 92 is a resin-molded product. The retainers 92*b* can be provided at different positions in the rotation direction with respect to the driven claws 92*a*. Accordingly, the second drive transmitter 92 can be molded by two molds relatively moving in the thrust direction. Thus, the manufacturing cost can be reduced.

Each of the driven claws 92*a* receives a driving force from the corresponding drive claw 91*a* and receives a predetermined load torque. The driven claws 92*a* need to have a certain degree of strength so as not to be damaged by the load torque. Therefore, the driven claws 92*a* have a certain thickness and width. If the driven claws 92*a* have a certain thickness and width as described above, a sink mark may occur in the driven claws 92*a* and the accuracy of the driven claws 92*a* might not be high. Accordingly, the contact state of the driven claws 92*a* with the drive claws 91*a* might be deteriorated, and the driven claws 92*a* and the drive claws 91*a* might be damaged.

For this reason, in the present embodiment, a lightening portion N is provided in each of the driven claws 92*a*. As a result, the occurrence of sink marks can be restrained, and a decrease in the accuracy of the driven claws 92*a* can be restrained.

As illustrated in FIGS. 5A and 5B, both axial ends of the drive shaft 94 include D-cut portions 9*a* and 94*b* having a D-shaped cross section including a planar portion and a circumferential portion. A conveyance electromagnetic clutch 84 (see FIGS. 3A and 3B) is attached to the D-cut portion 94*b*. The D-cut portion 94*b* is long in the axial direction and disposed on the motor side. On the other hand, the first drive transmitter 91 is attached to the D-cut portion 94*a*. The D-cut portion 9*a* is short in the axial direction and disposed on the roller side. The first drive transmitter 91 is attached to the drive shaft 94 so as to rotate integrally with the drive shaft 94.

A retaining ring groove 94*d* is provided at the center of the drive shaft 94 in the axial direction of the drive shaft 94. A retaining ring 96 that is fitted into the retaining ring groove 94*d* restricts movement of the bearing 83*a*, to which the input gear 83 is attached, toward the motor. A retaining ring groove 94*c* is provided at a roller-side end of the drive shaft 94. A retaining ring 93 that restricts the first drive transmitter 91 from coming off the drive shaft 94 is fitted into the retaining ring groove 94*c*.

The second drive transmitter 92 is provided between the first drive transmitter 91 of the drive shaft 94 and the bearing 83*a*. The second drive transmitter 92 is supported by the drive shaft 94 so as to be rotatable relative to the drive shaft 94.

In the present embodiment, the first drive transmitter 91 that rotates integrally with the drive shaft 94 is attached to a position closer to the end of the drive shaft 94 than the second drive transmitter 92 is. With such a configuration, the D-cut portion 9*a* formed such that the first drive transmitter 91 rotates integrally with the drive shaft 94 may be provided only in the vicinity of the end of the drive shaft 94. The D-cut portion 9*a* forms a flat surface portion by cutting. Accordingly, if the D-cut portion 9*a* is short, the processing time can be shortened, which leads to a reduction in manufacturing cost.

As illustrated in FIG. 4, the first drive transmitter 91 is attached to the drive shaft 94 such that the driven claws 92*a* of the second drive transmitter 92 are inserted into a communication space surrounded by the drive claws 91*a*, the outer ring 91*b*, and the cylindrical shaft-insertion receiving portion 91*c* (see also FIGS. 5A and 5B).

In the present embodiment, portions of the first drive transmitter 91 into which the driven claws 92*a* enter communicate with each other in the axial direction. Accordingly, even when the first drive transmitter 91 is reversed from a state illustrated in FIGS. 5A and 5B and assembled to the drive shaft 94, the driven claws 92*a* can enter between the drive claws 91*a*. As described above, in the present embodiment, the assembling direction of the first drive transmitter 91 with respect to the drive shaft 94 is not limited to a single direction. Thus, the first drive transmitter 91 can be easily assembled to the drive shaft 94.

As illustrated in FIG. 4, certain clearances are provided in the rotational direction between the drive claws 91*a* and the drive claws 92*a* that have entered between the drive claws 91*a*. As described above, the second drive transmitter 92 is rotatably supported with respect to the drive shaft 94. Accordingly, the second drive transmitter 92 is movable relative to the first drive transmitter 91 within the range of the angle θ illustrated in FIG. 4.

In the present embodiment, the drive claws 91*a* are radial claws protruding radially. The driven claws 92*a* are thrust claws protruding in the thrust direction, and the driven claws 92*a* enter between the drive claws 91*a*. However, the opposite configuration may also be employed. That is, the driven claws 92*a* may be radial claws and the drive claws 91*a* may be thrust claws. Thus, the drive claws 91*a* may enter between the driven claws 92*a*.

However, the direction in which the drive transmitter provided with the thrust claws is assembled to the drive shaft 94 is determined. Thus, preferably, the thrust claws are provided to one of the first drive transmitter 91 and the second drive transmitter 92 that is assembled to the drive shaft 94 in the determined direction. In the present embodiment, the second drive transmitter 92 includes the pulley 92*c*. Accordingly, it is necessary to assemble the second drive transmitter 92 to the drive shaft 94 such that the driven claws 92*a* are closer to the drive roller 81 (the first drive transmitter 91) than the pulley 92*c* is. Thus, the direction of assembly of the second drive transmitter 92 to the drive shaft 94 is determined. Therefore, in the present embodiment, the driven claws 92*a* of the second drive transmitter 92 whose direction of assembly to the drive shaft 94 is determined serve as thrust claws.

Forming the drive claws 91*a* of the first drive transmitter 91 as the radial claws allow the first drive transmitter 91 to be assembled to the drive shaft 94 even when the first drive transmitter 91 is reversed from the state illustrated in FIGS. 5A and 5B as described above.

In the present embodiment, the second drive transmitter 92 is relatively movable within a predetermined angular range by the first drive transmitter 91. Accordingly, the linear velocity of the upper additional conveyance roller pair 52*a* is higher than the linear velocity of the lower additional conveyance roller pair 52*b*. When the sheet is stretched between the lower additional conveyance roller pair 52*b* and the upper additional conveyance roller pair 52*a* and the sheet pulls the lower additional conveyance roller pair 52*b* in the rotation direction, the second drive transmitter 92 rotates relative to the first drive transmitter 91. Thus, the drive coupling between the first drive transmitter 91 and the second drive transmitter 92 is released. Accordingly, the lower additional conveyance roller pair 52*b* rotates (idles) at the sheet conveyance speed of the upper additional conveyance roller pair 52*a*. As a result, the lower additional conveyance roller pair 52*b* does not slip with the sheet, and a slip sound is not generated.

In addition, in the present embodiment, the additional conveyance roller pair 52 can be idled by the two components (the first drive transmitter 91 and the second drive transmitter 92), and the number of components can be reduced as compared with a case in which the additional conveyance roller pair 52 is idled by a one-way clutch, and the cost of the additional sheet feeding device can be reduced.

The idle rotation angle θ [rad] of the idling mechanism 90, which is an angle at which the second drive transmitter 92 can rotate relative to the first drive transmitter 91, is determined by the diameters of the drive rollers of the additional sheet feed conveyance rollers, the linear velocity difference between the upper additional conveyance roller pair 52*a* and the upper additional conveyance roller pair 52*a*, and the sheet length from the lower additional conveyance roller pair 52*b* to the rear end of the sheet when the leading end of the sheet reaches the upper additional conveyance roller pair 52*a*. Specifically, the idle rotation angle θ can be expressed by the following equation 1, in which D [mm] is the radius of the drive rollers of the additional conveyance roller pair 52*b*, V1[mm/s] is the linear velocity of the upper additional conveyance roller pair 52*a*, V2 [mm/s] is the linear velocity of the lower additional conveyance roller pair 52*b*, L1 [mm] is the sheet conveyance distance from the lower additional conveyance roller pair 52*b* to the upper additional conveyance roller pair 52*a*, LMAX [mm] is the maximum sheet length of a sheet that can be placed on the additional sheet feeding tray 70, and Z is the deceleration ratio from the second drive transmitter 92 to the drive roller of the additional feed conveyance roller pair.

$$\theta=\{2Z(V1-V2)(\mathrm{LMAX}-L1)\}/V1D \quad \text{(equation 1)}$$

For example, the idling angle θ=0.42≈24 [deg], when D=10 [mm], the maximum linear velocity difference (V1−V2) between the upper additional conveyance roller pair 52*a* and the lower additional conveyance roller pair 52*b* V2 due to manufacturing error is 1 [m m/s], the deceleration ratio Z=0.5 (the number of teeth of the pulley 92*c*: 20, the number of teeth of the driven pulley 89: 10), and (LMAX−L1)≈420 [mm] Accordingly, in such a configuration, when the second drive transmitter 92 is rotatable relative to the first drive transmitter 91 by 24 [deg] or more, the lower additional conveyance roller pair 52*b* can be idled until the rear end of the sheet passes through the lower additional conveyance roller pair 52*b*. Thus, no slip noise is generated.

The driving device 80 described above is also mounted on the upper additional sheet feeder 50*a*. Accordingly, when the linear velocity of the regular conveyance roller pair 12 is higher than the linear velocity of the upper additional conveyance roller pair 52*a*, the sheet is stretched between the upper additional conveyance roller pair 52*a* and the regular conveyance roller pair 12, and the upper additional conveyance roller pair 52*a* is pulled in the rotation direction, the upper additional conveyance roller pair 52*a* can rotate (idle) at the sheet conveyance speed of the regular conveyance roller pair 12. As a result, the upper additional conveyance roller pair 52*a* does not slip with the sheet, and a slip sound is not generated.

Next, a variation of the idling mechanism is described.

Figure 7:
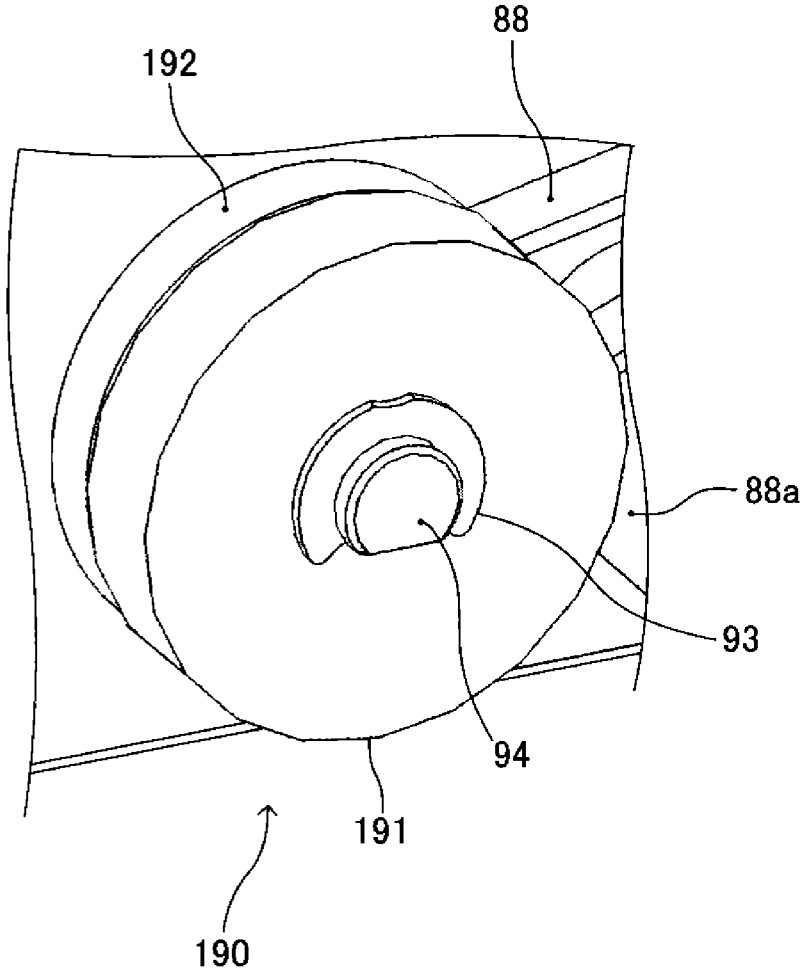
FIG. 7 is a perspective view of an idling mechanism according to a variation of the present disclosure.

FIG. 7 is a perspective view of an idling mechanism 190 according to the variation.

Figure 8A:
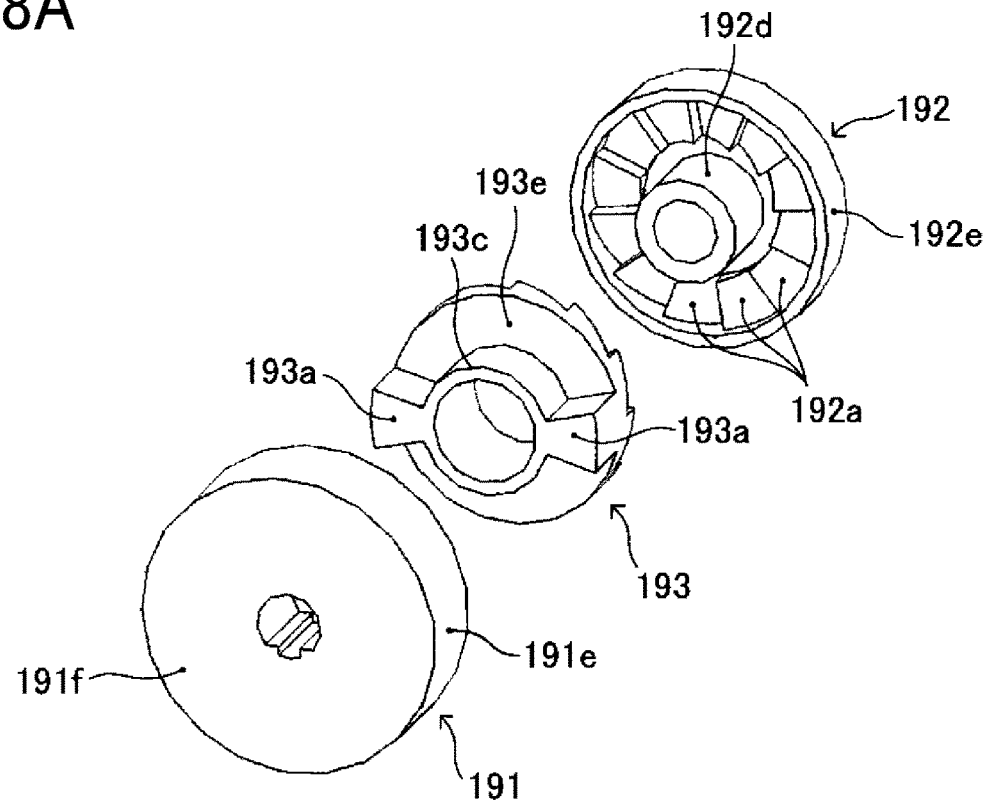
FIGS. 8A and 8B are exploded perspective views of the idling mechanism of FIG. 7.
Figure 8B:
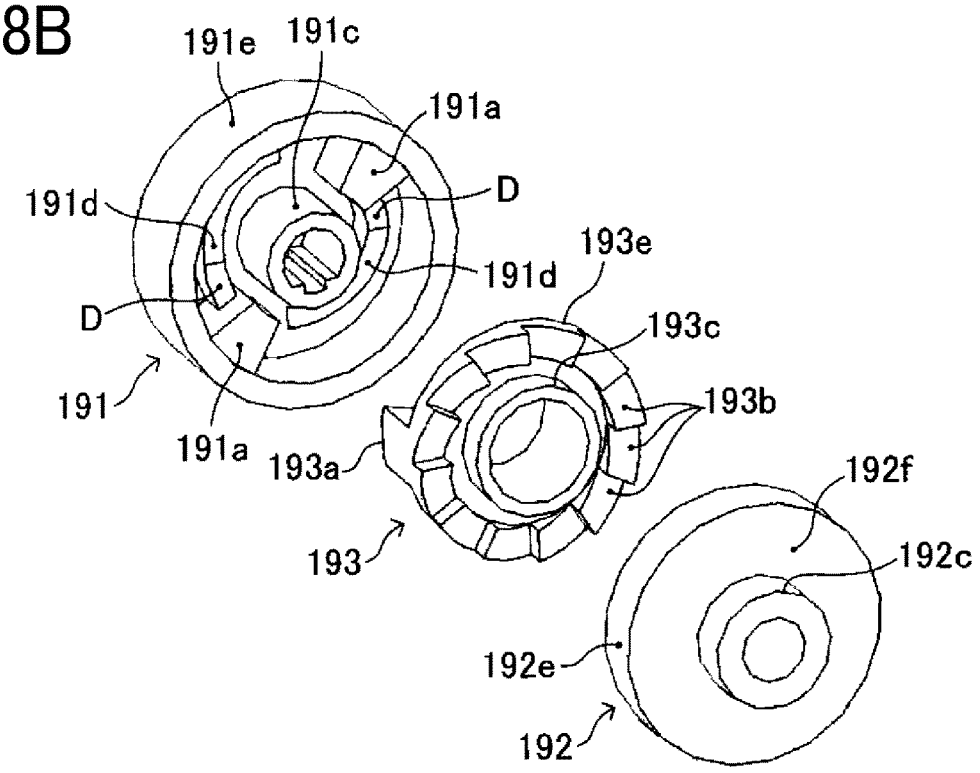

FIGS. 8A and 8B are exploded perspective views of the idling mechanism 190 according to the variation. FIG. 8A is an exploded perspective view of the idling mechanism 190 according to the variation viewed from one side (roller side) in the axial direction. FIG. 8B is an exploded perspective view of the idling mechanism 190 according to the variation viewed from the other side (drive motor side) in the axial direction.

In the idling mechanism 190 according to the variation, an intermediate member 193 is disposed between a first drive transmitter 191 and a second drive transmitter 192. A driving force is transmitted from the first drive transmitter 191 via the intermediate member 193 to the second drive transmitter 192. The intermediate member 193 is supported by the first drive transmitter 191 and the second drive transmitter 192 so as to be movable in the thrust direction and rotatable.

The first drive transmitter 191 to which the driving force is transmitted from the drive shaft 94 includes a cylindrical shaft-insertion receiving portion 191*c* and an outer ring 191*e* having a cylindrical shape, and a connecting wall 191*f* orthogonal to the axial direction that connects the shaft-insertion receiving portion 191*c* and the outer ring 191*e* at an axial end of one axial side (roller side) of the first drive transmitter 191.

Two drive claws 191*a* are provided at an interval of 180° in the rotation direction so as to extend from the inner peripheral surface of the outer ring 191*e* toward the cylindrical shaft-insertion receiving portion 91*c*. An opposing surface of the connecting wall 191*f* facing the intermediate member 193 includes inclined portions 191*d* each having one end connected to a downstream end of the corresponding drive claw 191*a* in the driving rotation direction and inclined so as to be away from the intermediate member 193 toward the downstream side in the driving rotation direction.

The second drive transmitter 192 includes an intermediate holder 192*d* having a cylindrical shape that rotatably holds the intermediate member 193, an outer ring 192*e* that faces an outer peripheral surface of the intermediate holder 192*d*, and a connecting wall 192*f* that is orthogonal to the axial direction and connects the intermediate holder 192*d* and the outer ring 192*e* to each other at an end (motor side) of the outer ring 192*e*. A pulley 192*c* around which the timing belt 88 is wound is provided on the other end (motor side) in the axial direction with respect to the connecting wall 192*f*.

On a surface of the connecting wall 192*f* of the second drive transmitter 192 facing the intermediate member 193, a plurality of inclined claws 192*a* inclined so as to be away from the intermediate member 193 toward the downstream in the drive rotation direction, are provided in the rotation direction.

The intermediate member 193 includes a cylindrical support portion 193*c* and a disk 193*e*. The shaft-insertion receiving portion 191*c* of the first drive transmitter 191 and the intermediate holder 192*d* of the second drive transmitter 192 are inserted into the cylindrical support portion 193*c*. The disk 193*e* radially extends from a substantially central portion of the cylindrical support portion 193*c* in the axial direction.

On a surface of the disk 193*e* facing the first drive transmitter 191, two drive claws 191*a* that come into contact with first claws 193*a* from the rotation direction are provided at an interval of 180° in the rotation direction.

On a plurality of inclined claws 193*b* facing the second drive transmitter 192, there are provided a plurality of inclined claws 192*a* inclined so as to be away from the second drive transmitter 192 toward upstream in the drive rotation direction in which the inclined claws 193*b* of the second drive transmitter 192 mesh with each other.

The intermediate member 193 is rotatably held by the first drive transmitter 191 and the second drive transmitter 192 and accommodated in the first drive transmitter 191 and the second drive transmitter 192.

Figure 9A:
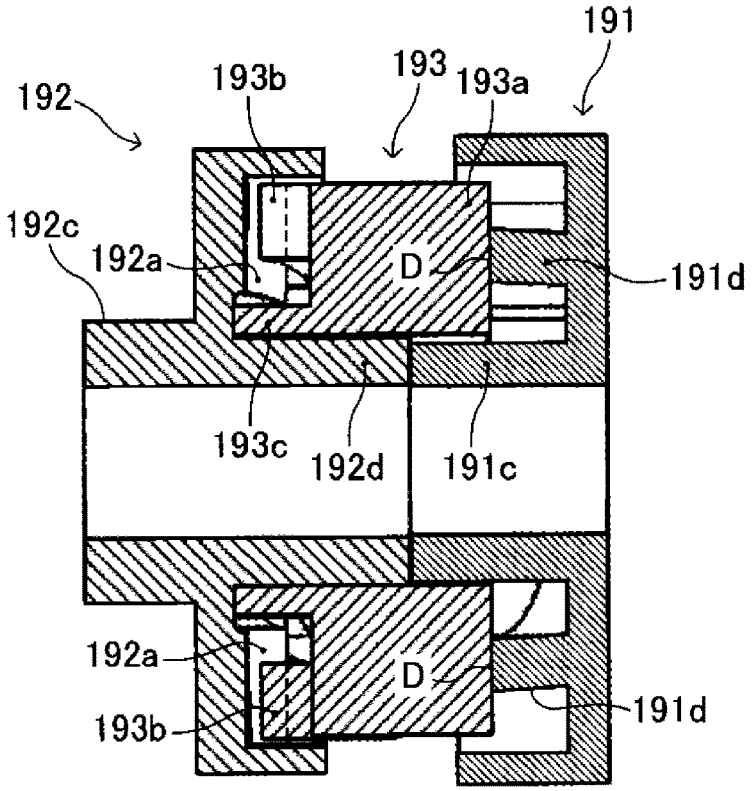
FIGS. 9A and 9B are views illustrating an operation of the idling mechanism according to the variation of the present disclosure.
Figure 9B:
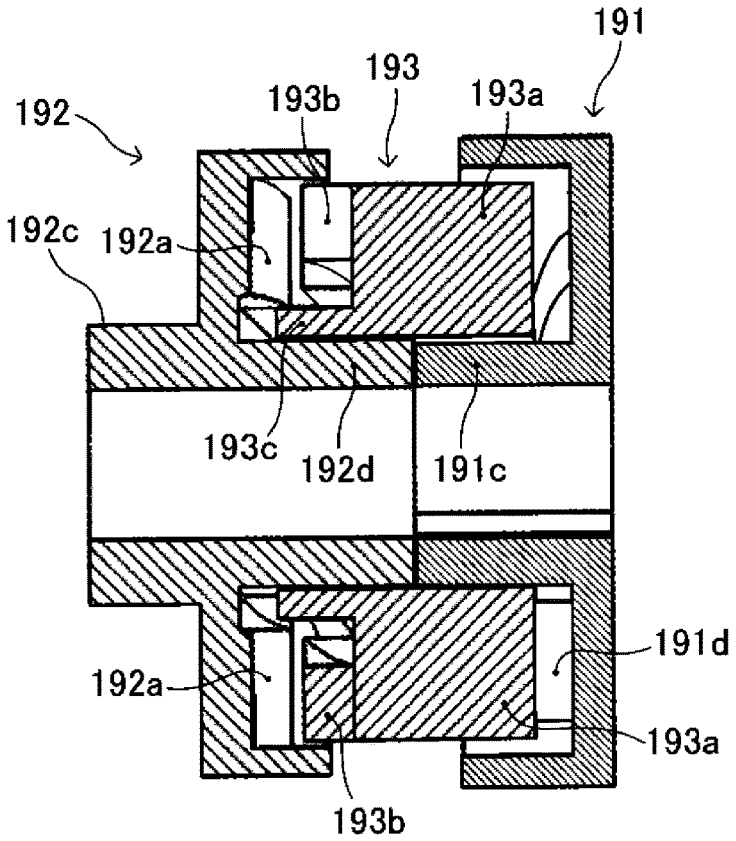

FIGS. 9A and 9B are diagrams illustrating an operation of the idling mechanism 190 according to the variation. FIG. 9A illustrates a state in which the first drive transmitter 191 and the second drive transmitter 192 are coupled, and FIG. 9B illustrates a state in which the first drive transmitter 191 and the second drive transmitter 192 are idle.

As illustrated in FIG. 9A, at the time at which the first drive transmitter 191 and the second drive transmitter 192 are coupled, the first claws 193*a* of the intermediate member 193 abut against the drive claws 191*a* from downstream in the drive rotation direction, and the driving force is transmitted from the drive claws 191*a* to the first claws 193*a*. In addition, top portions D of the inclined portions 191*d* of the first drive transmitter 191 are in contact with the first claws 193*a* in the axial direction, and the intermediate member 193 is positioned on the second drive transmitter 192.

When the intermediate member 193 is positioned on the second drive transmitter 192, the inclined claws 193*b* of the intermediate member 193 mesh with the inclined claws 192*a* of the second drive transmitter 192. As a result, the driving force transmitted from the drive claws 191*a* to the intermediate member 193 is transmitted to the second drive transmitter 192. Then, the driving force is transmitted from the second drive transmitter 192 to the drive roller of the additional conveyance roller pair 52 via the timing belt 88, and the additional conveyance roller pair 52 is rotationally driven.

When the sheet pulls in the lower additional conveyance roller pair 52*b* in the rotation direction and the rotation speed of the second drive transmitter 192 is higher than the rotation speed of the first drive transmitter 191, the intermediate member 193 is pressed by the inclined surfaces of the inclined claws 192*a* of the second drive transmitter 192 and rotates together with the second drive transmitter 192. As a result, each of the first claws 193*a* of the intermediate member 193 is separated from corresponding one of the drive claws 191*a*, and the drive coupling between the intermediate member 193 and the first drive transmitter 191 is released. Accordingly, the lower additional conveyance roller pair 52*b* rotates (idles) at the sheet conveyance speed of the upper additional conveyance roller pair 52*a*.

At this time, the intermediate member 193 is pushed out from the inclined surfaces of the inclined claws 192*a* of the second drive transmitter 192 toward the first drive transmitter 191 in the thrust direction. Therefore, while rotating together with the second drive transmitter 192, the intermediate member 193 moves toward the first drive transmitter 191 so that the first claws 193*a* run down the inclined portions 191*d* of the first drive transmitter 191. Finally, as illustrated in FIG. 9B, the second drive transmitter 192 is disengaged from the inclined claws 192*a*.

When the engagement with the inclined claws 192*a* of the second drive transmitter 192 is released, the intermediate member 193 is pressed by the inclined portions 191*d* of the first drive transmitter 191. While rotating together with the first drive transmitter 191, the first claws 193*a* run up the inclined portions 191*d*, and the intermediate member 193 moves to the second drive transmitter 192. Then, the inclined claws 193*b* of the intermediate member 193 mesh with the inclined claws 192*a* of the second drive transmitter 192 again. When the inclined claws 193*b* of the intermediate member 193 mesh with the inclined claws 192*a* of the second drive transmitter 192, the intermediate member 193 moves to the first drive transmitter 191 again while rotating together with the second drive transmitter 192.

The intermediate member 193 reciprocates between the first drive transmitter 191 and the second drive transmitter 192 until the rear end of the sheet passes through the lower additional conveyance roller pair 52*b*. When the rear end of the sheet passes through the lower additional conveyance roller pair 55*b*, the lower additional conveyance roller pair 52*b* does not receive force in the rotation direction from the sheet. Accordingly, the inclined claws 193*b* of the intermediate member 193 do not receive force from the inclined surfaces of the inclined claws 192*a* of the second drive transmitter 192 when the inclined claws 193*b* of the intermediate member 193 engage with the inclined claws 192*a* of the second drive transmitter 192. Thus, the intermediate member 193 does not move toward the first drive transmitter 191, and is in the state illustrated in FIG. 9A, which is the drive coupling state.

The idling mechanism according to the variation allows idling of 360°. Accordingly, for example, it is necessary to set a large deceleration ratio Z, and the present variation can be applied to an apparatus having the idling angle of equal to or greater than 360°.

The embodiments of the present disclosure applied to the additional sheet feeding device 50 have been described above. However, an embodiment of the present disclosure can be applied to any sheet conveyance device that conveys a sheet by a plurality of conveyance roller pairs, such as the sheet conveyance device of the image forming device 10.

The configurations according to the above-descried embodiments are examples. The present disclosure can provide, for example, the following aspects. Aspect 1

A sheet conveyance device such as the additional sheet feeding device 50 includes a first conveyance member such as the upper additional conveyance roller pair 52*a* to convey a sheet toward a second conveyance member such as the lower additional conveyance roller pair 55*b*, and a drive transmission mechanism to transmit a driving force of a driving source such as the drive motor 81 to the first conveyance member. The drive transmission mechanism includes a first drive transmitter such as the first drive transmitter 91 and a second drive transmitter such as the second drive transmitter 92 disposed coaxially with the first drive transmitter 91. The driving force is transmitted from the first drive transmitter to the second drive transmitter. The second drive transmitter such as the second drive transmitter 92 is rotatable relative to the first drive transmitter such as the first drive transmitter 91 within a predetermined angular range.

In general, a one-way clutch includes an outer ring, an inner ring, a plurality of rollers provided between the outer ring and the inner ring, and a plurality of springs for biasing the respective rollers and is expensive due to a large number of components.

According to Aspect 1, when the sheet conveyance speed of the first conveyance member such as the upper additional conveyance roller pair 52*a* is higher than the sheet conveyance speed of the second conveyance member such as the lower additional conveyance roller pair 55*b*, the first conveyance member is pulled by a sheet such as a sheet of paper and tends to rotate fast. At this time, the second drive transmitter such as the second drive transmitter 92 that transmits the driving force to the first conveyance member attempts to rotate fast together with the first conveyance member. Then, the second drive transmitter such as the second drive transmitter 92 rotates relative to the first drive transmitter such as the first drive transmitter 91, and the drive coupling between the second drive transmitter and the first drive transmitter is released. As a result, the driving force is not transmitted from the driving source to the first conveyance member, and the first conveyance member rotates (idles) at the sheet conveyance speed of the second conveyance member.

The second drive transmitter such as the second drive transmitter 92 is rotatable relative to the first drive transmitter such as the first drive transmitter 91 at least within a predetermined angular range such as the idling angle θ calculated by the above-described equation (1). Such a configuration allows the first conveyance member to be kept idling until the rear end of the sheet passes through the first conveyance member.

As described above, in Aspect 1, the first conveyance member can be idled by the two members of the first drive transmitter such as the first drive transmitter 91 and the second drive transmitter such as the second drive transmitter 92, and the number of components can be reduced as compared with the case in which the first conveyance member is idled by a one-way clutch, and the cost of the device can be reduced.

Aspect 2

In Aspect 1, the first drive transmitter such as the first drive transmitter 91 is supported by a rotary shaft such as the drive shaft 94 that is rotationally driven by the driving force of a drive source such as the drive motor 81 so as to rotate integrally with the rotary shaft. The second drive transmitter such as the second drive transmitter 92 is supported by the rotary shaft so as to be rotatable with respect to the rotary shaft. The first drive transmitter such as the first drive transmitter 91 is supported closer to the end of the rotary shaft than the second drive transmitter such as the second drive transmitter 92.

According to the above-described configuration, as described in the above-described embodiments, for example, the D-cut portion 9*a* of the rotary shaft may be formed only on an end of the rotary shaft to allow the first drive transmitter such as the first drive transmitter 91 to rotate integrally with the rotary shaft such as the drive shaft 94. Thus, as compared with a configuration in which the second drive transmitter 92 is closer to the end of the rotary shaft than the first drive transmitter 91 is, the number of processes performed on the rotary shaft and the manufacturing cost can be reduced.

Aspect 3

In Aspect 1 or 2, the first drive transmitter such as the first drive transmitter 91 and the second drive transmitter such as the second drive transmitter 92 each have claws. The driving force is transmitted from the claws such as the drive claws 91*a* of the first drive transmitter such as the first drive transmitter 91 to the claws such as the driven claws 92*a* of the second drive transmitter such as the second drive transmitter 92, and at least one of the claws of the first drive transmitter and the claws of the second drive transmitter includes a lightening portion.

According to this configuration, the occurrence of sink marks during molding can be restrained and the claws can be manufactured with high accuracy.

Aspect 4

In any one of Aspects 1, 2, and 3, one of the first drive transmitter such as the first drive transmitter 91 and the second drive transmitter such as the second drive transmitter 92 (in the above-described embodiments, the first drive transmitter 91) includes a plurality of radial claws (in the above-described embodiments, the drive claws 91*a*) radially extending at predetermined intervals in a rotation direction. The other drive transmitter (in the above-described embodiments, the second drive transmitter 92) includes a plurality of thrust claws (in the above-described embodiment, the driven claws 92*a*) extending in the thrust direction and interposed between the radial claws at predetermined intervals in the rotation direction and a coupling portion such as the outer ring 91*b* coupling between adjacent radial claws.

Such a configuration, as described in the above-described embodiments, can reinforce the radial claws such as the drive claws 91*a* and the like restrain breakage of the radial claws.

Aspect 5

In Aspect 4, portions between the radial claws communicate with each other in the axial direction.

Such a configuration, as described in the above-described embodiments, allows the thrust claws to enter between the radial claws from any one of axial directions with respect to the drive transmitter having the radial claws. Owing to this structure, the drive transmitter having the radial claws can be assembled to the rotary shaft either in a first posture in which the drive transmitter can be assembled to the rotary shaft such as the drive shaft 94 or in a second posture in which the drive transmitter is inverted with respect to the first posture.

Aspect 6

In any one of Aspects 3, 4, and 5, the second drive transmitter such as the second drive transmitter 92 includes a pulley such as the pulley 92*c* around which a belt member such as the timing belt 88 is wound, and the claws such as the driven claws 92*a* of the second drive transmitter such as the second drive transmitter 92 radially protruding from one end of the pulley such as the pulley 92*c*.

Such a configuration, as described in the above-described embodiments, can prevent the belt member such as the timing belt 88 from coming off from the pulley such as the pulley 92*c* by claws such as the driven claws 92*a*.

Aspect 7

In Aspect 6, retainers such as the retainers 92*b* that radially protrude and prevent the belt member such as the timing belt 88 from coming off from the pulley such as the pulley 92*c* is provided at the other end of the pulley such as the pulley 92*c*. The retainers such as the retainers 92*b* and the claws such as the driven claws 92*a* of the second drive transmitter are located at different positions in the rotation direction.

Such a configuration, as described in the above-described embodiments, allows to mold the second drive transmitter with two molds relatively moving in the axial direction and the manufacturing cost can be reduced.

Aspect 8

In Aspect 1 or Aspect 2, an intermediate member such as the intermediate member 193 is provided between the first drive transmitter such as the first drive transmitter 191 and the second drive transmitter such as the second drive transmitter 192 and is movable in the thrust direction. The second drive transmitter such as the second drive transmitter 192 receives the driving force from the first drive transmitter such as the first drive transmitter 191 via the intermediate member such as the intermediate member 193. When the intermediate member such as the intermediate member 193 moves toward the first drive transmitter such as the first drive transmitter 191, the drive coupling between the second drive transmitter such as the second drive transmitter 192 and the intermediate member such as the intermediate member 193 is released.

Such a configuration, as described in the above-described variation, allows the intermediate member such as the intermediate member 193 to move toward the first drive transmitter such as the first drive transmitter 191 to interrupt the drive coupling between the first drive transmitter such as the first drive transmitter 191 and the second drive transmitter such as the second drive transmitter 192. Thus, the first conveyance member can be idled and rotated at the sheet conveyance speed of the second conveyance member.

Aspect 9

In Aspect 8, the intermediate member such as the intermediate member 193 includes first claws such as the first claws 193*a* and second claws such as the inclined claws 193*b*. The first claws such as the first claws 193*a* extend in a thrust direction and a driving force is transmitted from the claws of the first drive transmitter such as the drive claws 191*a* of the first drive transmitter 191 to the first claws such as the first claws 193*a*. The second claws of the second drive transmitter such as the inclined claws 193*b* of the second drive transmitter 192 extend in the thrust direction. The second claws transmit a driving force to the claws of the second drive transmitter such as the inclined claws 192*a* of the second drive transmitter 192. The claws of the first drive transmitter such as the first drive transmitter 191 are coupled with inclined portions such as the inclined portions 191*d* contacting the first claws such as the first claws 193*a* from the thrust direction and having a gradient in the thrust direction. The claws of the second drive transmitter such as the second drive transmitter 192 are coupled with inclined portions which the second claws contact from the thrust direction and that have a gradient on the thrust direction.

According to the above configuration, as described in Variation 1, when the first conveyance member is pulled by a sheet such as a sheet of paper and rotates fast, the claws of the intermediate member such as the intermediate member 193 are pressed by the inclined portions of the second drive transmitter, and the intermediate member rotates together with the second drive transmitter relative to the first drive transmitter. As a result, the first claws of the intermediate member such as the intermediate member 193 are separated from the claws of the first drive transmitter. Thus, the drive transmission between the second drive transmitter 192 and the first drive transmitter 191 is interrupted. Accordingly, the first conveyance member can be idled and the first conveyance member can be rotated at the sheet conveyance speed of the second conveyance member.

Further, when the second claws are pressed by the inclined portions of the second drive transmitter, the intermediate member moves toward the first drive transmitter and separates from the second claws and the claws of the second drive transmitter. Accordingly, the second drive transmitter rotates relative to the intermediate member 193. Thus, even when the first claws of the intermediate member such as the intermediate member 193 abut against the claws of the first drive transmitter and the relative rotation of the intermediate member such as the intermediate member 193 with respect to the first drive transmitter is restricted, the second drive transmitter can continue to rotate relative to the first drive transmitter. Accordingly, the second drive transmitter relative to the first drive transmitter can be rotated by 360°.

Further, after the second claws are separated from the claws of the second drive transmitter, the first claws are pressed by the inclined portions of the first drive transmitter and move toward the second drive transmitter while rotating together with the first drive transmitter, so that the second claws can be brought into contact with the claws of the second drive transmitter.

Aspect 10

A sheet feeding device includes a sheet loader such as the additional sheet feeding tray 70 on which a sheet is placed and a conveying device to convey the sheet placed on the sheet loader. The sheet conveyance device according to any one of Aspects 1 to 9 is used as the conveying device.

Such a configuration can reduce the cost of the sheet feeding apparatus.

Aspect 11

An image forming apparatus includes a conveying device that conveys a sheet and forms an image on the sheet conveyed by the conveying device. The sheet conveyance device according to any one of Aspects 1 to 10 is used as the conveying device.

Such a configuration can reduce the cost of the image forming apparatus.

The above-described embodiments may be implemented in combination with each other.

The present disclosure is not limited to specific embodiments described above, and numerous additional modifications and variations are possible in light of the teachings within the technical scope of the appended claims. It is therefore to be understood that, the disclosure of the present specification may be practiced otherwise by those skilled in the art than as specifically described herein, and such, modifications, alternatives are within the technical scope of the appended claims. Such modifications and alternatives are within the technical scope of the present disclosure.

In the above descriptions, the term "printing" in the present disclosure may be used synonymously with, e.g. the terms of "image formation", "recording", "printing", and "image printing".

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present disclosure.

What is claimed is:

1. A sheet conveyance device comprising:

a first conveyor to convey a sheet toward a second conveyor; and a drive transmission mechanism to transmit a driving force of a driving source to the first conveyor, wherein the drive transmission mechanism includes:

a first drive transmitter; and a second drive transmitter disposed coaxially with the first drive transmitter and to which the driving force is transmitted from the first drive transmitter, the second drive transmitter being rotatable relative to the first drive transmitter within at least a predetermined angular range, wherein each of the first drive transmitter and the second drive transmitter includes a claw, wherein the driving force is to be transmitted from the claw of the first drive transmitter to the claw of the second drive transmitter, and wherein at least one of the claw of the first drive transmitter and the claw of the second drive transmitter includes a recess.

2. The sheet conveyance device according to claim 1, further comprising:

a rotary shaft supporting the first drive transmitter such that the first drive transmitter receives the driving force of the driving source and is rotationally driven by the driving force of the driving source so as to rotate integrally with the rotary shaft, wherein the second drive transmitter is supported by the rotary shaft so as to be rotatable with respect to the rotary shaft, and wherein the first drive transmitter is supported at a position closer to an end of the rotary shaft than the second drive transmitter is.

3. The sheet conveyance device according to claim 1, wherein one of the first drive transmitter and the second drive transmitter includes a plurality of radial claws radially extending at predetermined intervals in a rotation direction of the one of the first drive transmitter and the second drive transmitter, wherein the other of the first drive transmitter and the second drive transmitter includes a plurality of thrust claws extending in a thrust direction and entering between the plurality of radial claws at predetermined intervals in the rotation direction, and wherein the one of the first drive transmitter and the second drive transmitter includes a coupler coupling adjacent ones of the plurality of radial claws.

4. The sheet conveyance device according to claim 1, further comprising:

a belt, wherein the second drive transmitter includes a pulley around which the belt is wound, and wherein the claw of the second drive transmitter radially protrudes from one axial end of the pulley.

5. The sheet conveyance device according to claim 4, further comprising:

a retainer that radially protrudes at the other axial end of the pulley and prevents the belt from coming off from the pulley, wherein the retainer and the claw of the second drive transmitter are at different positions in a rotation direction of the second drive transmitter.

6. A sheet feeding device comprising:

a sheet loader on which a sheet is placed; and the sheet conveyance device according to claim 1 to convey the sheet placed on the sheet loader.

7. An image forming apparatus comprising:

the sheet conveyance device according to claim 1 to convey a sheet; and an image forming device to form an image on the sheet conveyed by the sheet conveyance device.

8. A sheet conveyance device comprising:

a first conveyor to convey a sheet toward a second conveyor; and a drive transmission mechanism to transmit a driving force of a driving source to the first conveyor, wherein the drive transmission mechanism includes:

a first drive transmitter; and a second drive transmitter disposed coaxially with the first drive transmitter and to which the driving force is transmitted from the first drive transmitter, the second drive transmitter being rotatable relative to the first drive transmitter within at least a predetermined angular range, the sheet conveyance device further comprising:

an intermediate member between the first drive transmitter and the second drive transmitter and movable in a thrust direction, wherein the second drive transmitter is to receive the driving force from the first drive transmitter via the intermediate member, and wherein the intermediate member is to move toward the first drive transmitter to interrupt a drive transmission between the second drive transmitter and the first drive transmitter, wherein the intermediate member is rotatable relative to the first drive transmitter and the second drive transmitter, wherein the intermediate member includes:

a first claw extending in the thrust direction to receive the driving force from the claw of the first drive transmitter; and a second claw extending in the thrust direction to transmit the driving force to a claw of the second drive transmitter into a claw of the first drive transmitter, wherein the claw of the first drive transmitter is coupled with an inclined portion that contacts the first claw from the thrust direction and having a gradient in the thrust direction, and wherein the claw of the second drive transmitter is coupled with an inclined portion that contacts the second claw from the thrust direction and having a gradient in the thrust direction.

* * * * *